US011550262B2

(12) United States Patent
Papi

(10) Patent No.: US 11,550,262 B2
(45) Date of Patent: Jan. 10, 2023

(54) LEVER ESCAPEMENT ASSEMBLY FOR A TIMEPIECE MOVEMENT

(71) Applicant: Manufacture d'Horlogerie Audemars Piguet SA, Le Brassus (CH)

(72) Inventor: Giulio Papi, La Chaux-de-Fonds (CH)

(73) Assignee: MANUFACTURE D'HORLOGERIE AUDEMARS PIGUET SA, Le Brassus (CH)

( * ) Notice: Subject to any disclaimer, the term of this patent is extended or adjusted under 35 U.S.C. 154(b) by 319 days.

(21) Appl. No.: 16/906,294

(22) Filed: Jun. 19, 2020

(65) Prior Publication Data

US 2020/0401083 A1 Dec. 24, 2020

(30) Foreign Application Priority Data

Jun. 19, 2019 (CH) ..... 8322019

(51) Int. Cl.
*G04B 15/08* (2006.01)
*G04B 15/14* (2006.01)

(52) U.S. Cl.
CPC ..... *G04B 15/08* (2013.01); *G04B 15/14* (2013.01)

(58) Field of Classification Search
CPC ..... G04B 15/08; G04B 15/14
See application file for complete search history.

(56) References Cited

U.S. PATENT DOCUMENTS 2,481,213 A * 9/1949 Gummersall ..... G04B 15/08 70/463
3,462,942 A * 8/1969 Egger ..... G04B 15/08 968/79
3,630,018 A * 12/1971 Nicholas ..... G04C 5/005 74/1.5
4,122,665 A * 10/1978 Giger ..... G04B 15/14 968/102
2010/0208555 A1 8/2010 Hiraoka et al.
2015/0103637 A1* 4/2015 Marechal ..... G04B 15/08 368/130

(Continued)

FOREIGN PATENT DOCUMENTS

CH 2 209 12/1890
CH 44 855 9/1909

(Continued)

OTHER PUBLICATIONS

Switzerland search report, CH 8322019, dated Oct. 15, 2019.

*Primary Examiner* — Edwin A. Leon
*Assistant Examiner* — Kevin Andrew Johnston
(74) *Attorney, Agent, or Firm* — Nixon & Vanderhye

(57) ABSTRACT

An escapement is disclosed which includes pallets, a roller and a pin fastened to the roller, intended to cooperate with one another. The pallets have no guard pin and include a pallet fork intended to cooperate with the pin and the roller and including first and second horns delimiting an entry of the pallet fork. The roller has an anti-overbanking wall in which a notch is formed, in a region adjacent to the pin. The pallets, the roller and the pin are conformed and dimensioned in such a manner that, in the service position, the anti-overbanking wall is able to define an abutment for the first and second horns, and each of the horns is able to penetrate to the interior of the notch exclusively when the pin is at least partly situated in the entry of the pallet fork.

17 Claims, 6 Drawing Sheets

(56) References Cited

U.S. PATENT DOCUMENTS

| | | | | |
|---|---|---|---|---|
| 2015/0268631 | A1* | 9/2015 | Cusin | G04B 15/08 368/132 |

FOREIGN PATENT DOCUMENTS

| | | | | |
|---|---|---|---|---|
| CH | 567 293 | | 9/1975 | |
| CH | 699 273 | | 2/2010 | |
| CH | 699273 | B1 * | 2/2010 | G04B 15/08 |
| DE | 867 671 | | 2/1953 | |
| EP | 2 924 517 | A1 | 9/2015 | |
| GB | 679416 | A * | 9/1952 | |

* cited by examiner

LEVER ESCAPEMENT ASSEMBLY FOR A TIMEPIECE MOVEMENT

TECHNICAL FIELD

The present invention concerns an assembly for lever escapements, including pallets, a roller and a pin fastened to the roller, intended to cooperate, in a service position, with one another and with an escape wheel whilst being safe against overbanking, the pallets having no guard pin and including, on the one hand, an entry pallet and an exit pallet, intended to cooperate alternately with the escape wheel and, on the other hand, a pallet fork intended to cooperate with the pin and the roller and including first and second horns delimiting a pallet fork entry, the roller being at least partly situated at the same level as the pin, in the direction of the thickness of the roller, the roller having an anti-overbanking wall of cylindrical general shape in which a notch is formed, in a region adjacent to the pin, the pallets, the roller and the pin being conformed and dimensioned in such a manner that, in the service position, the anti-overbanking wall is able to define an abutment for the first and second horns.

PRIOR ART

An escapement including an assembly that has the above features was disclosed in the prior art a long time ago.

Indeed, the patent CH44855 dating from 1909 describes an escapement of this kind that is of reduced thickness compared to conventional escapements thanks to the absence of a guard pin on the pallet fork, the guard pin being typically arranged at a level different from that of the horns of the pallet fork in conventional escapements.

Despite such an advantage in terms of overall size, escapements of the above type did not conquer the market and conventional Swiss lever escapements including a guard pin have been far and away the most widespread for several decades.

The Applicant has undertaken thorough research on the subject of escapement geometries and has been able to demonstrate a disadvantage of the escapement mentioned hereinabove. Indeed, the escapement as described in the aforementioned Swiss patent suffers a risk of malfunction in the event of knocking given that the horn against which the roller pin abuts in this situation is liable to penetrate into the notch of the roller when the balance wheel changes rotation direction. There is then a risk of sudden stopping of the escapement and therefore of the corresponding timepiece movement, and even a risk of damaging the pallets.

DISCLOSURE OF THE INVENTION

A main object of the present invention is to propose an assembly enabling production of a reliable escapement having a reduced overall size compared to conventional escapements.

To this end, the present invention may more particularly concern an assembly of the type indicated above, in which the pallets, the roller and the pin are moreover conformed and dimensioned in such a manner that, in the service position, each of the horns is able to penetrate to the interior of the notch exclusively when the pin is at least partly situated in the entry of the pallet fork.

Thanks to these features, in operation, the only configuration of the assembly according to the invention in which a horn is able to penetrate into the notch of the roller is that in which that horn has to enter into the notch to allow normal pivoting of the pallet fork on either side of dead centre. Thus, there is obtained an escapement of reduced thickness the operation of which is completely reliable.

Each of the horns of the pallet fork preferably has an internal wall delimiting the entry of the pallet fork and an external wall conformed and dimensioned in such a manner that, in a knocking situation, the distance between the point of contact of the pin on the external wall of the horn concerned and the end of the external wall nearest the internal wall is greater than the distance between the pin and that of the junctions between the anti-overbanking wall and the notch that is nearest the horn concerned.

Thanks to these specific geometrical characteristics, each horn has a shape and dimensions such that it is not able to enter into the notch of the roller in the knocking situation but is able to penetrate thereinto only when the pin is at least partly situated in the pallet fork.

According to a preferred embodiment, in the service position, the pallets including a lever connecting the entry and exit pallets to the pallet fork and able to pivot between two extreme positions defining a maximum angle of travel of the pallets, the external wall of each of the horns may advantageously have, from its end nearest the internal wall, a first portion defining a safety surface and having a mean angle relative to the lever such that the safety surface is substantially tangential to the anti-overbanking wall when it is situated facing the latter, then a second portion at an angle of the order of 0 to 60° relative to the lever, preferably less than 45°, for example 30°, and extending at least to the point of contact of the pin on the external wall in the knocking situation.

In a particular variant embodiment, the pin may be fastened to the roller by means of a support produced as one with the roller.

Additionally or alternatively, the pin may be carried directly by the balance wheel.

Generally speaking, the present invention also concerns an escapement including an assembly having the features set out hereinabove associated with an escape wheel.

According to a preferred embodiment, this escapement may be intended to be arranged in such a manner that, in the service position, the distance between the rotation axes of the pallets and of the roller is at least equal to twice the distance between the rotation axes of the pallets and of the escape wheel.

The escapement may preferably be intended to be arranged in such a manner that, in the service position, the rotation axes of the escape wheel, of the pallets and of the roller are coplanar.

The present invention also concerns a timepiece movement including an escapement having the above features and possibly including banking pins arranged on respective opposite sides of the pallets to define its maximum angle of travel, as well as a timepiece including a timepiece movement of that kind.

BRIEF DESCRIPTION OF THE DRAWINGS

Other features and advantages of the present invention will become more clearly apparent on reading the following detailed description of a preferred embodiment given with reference to the appended drawings provided by way of nonlimiting example and in which.

EMBODIMENT(S) OF THE INVENTION

Figure 1A:
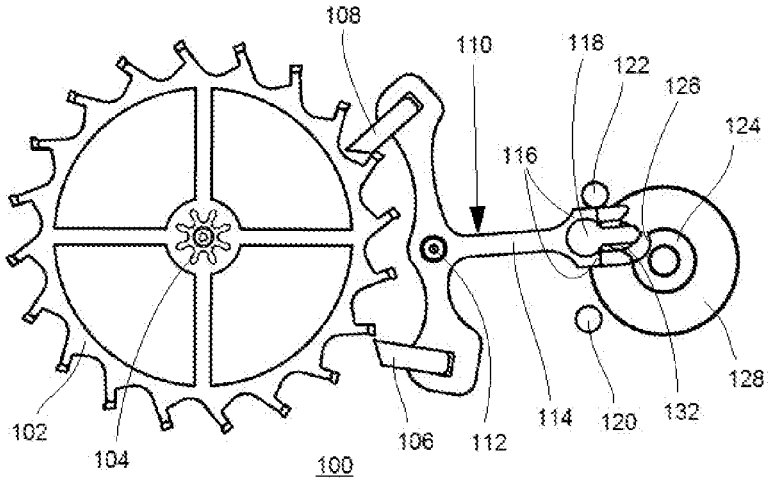
FIGS. 1*a* and 1 *b* represent a same simplified view from above of an assortment for a timepiece movement, respectively, of conventional Swiss lever type and according to a preferred embodiment of the present invention.

FIGS. 1*a*, 1 *b* and 2*a*, 2*b* represent simplified views, on the one hand from above and, on the other hand, partial and from the side of an assortment for timepiece movements, respectively of conventional Swiss lever type and in accordance with a preferred embodiment of the present invention. A comparative examination of these different views makes it possible to highlight the structural features that distinguish the assembly of components in accordance with the present invention from an assembly of components in accordance with the most commercially widespread prior art.

Figure 2A:
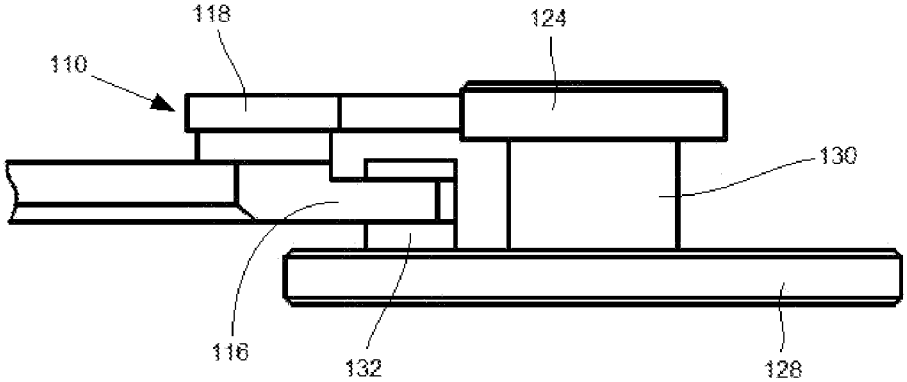
FIGS. 2*a* and 2*b* represent a same simplified side view of part of the respective assortments from FIGS. 1*a* and 1*b;*

In known manner, the Swiss lever escapement 100 shown in FIGS. 1*a* and 2*a* includes an escape wheel 102 fastened to an escape pinion 104 and adapted to cooperate with the entry pallet 106 and outlet pallet 108 of pallets 110 intended to pivot on its pallet-staff 112. A lever 114 connects the pallets 106, 108 to a pallet fork the entry of which is delimited by two horns 116. The pallet fork is surmounted by a guard pin 118 intended to make it safe against overbanking. An entry banking pin 120 and an exit banking pin 122 are typically provided to limit the amplitude of rotation of the pallets 110. The pallets are intended to cooperate with a double roller, in particular to retransmit some of the energy received from the escape wheel to the balance wheel (not visible) to maintain oscillation thereof. To this end, the double roller includes a small roller 124 the cylindrical periphery of which defines an anti-overbanking wall through its cooperation with the guard pin 118, this wall being provided with a notch 126 intended to allow rotation of the pallets 110 either side of dead centre by providing sufficient room to define a passage for the guard pin 118. The small roller 124 is generally fastened to a large roller 128 by means of a bush 130, the large roller 128 carrying a pin 132 intended to cooperate with the pallet fork of the pallets 110, on the one hand, to trigger rotation of the pallets 110 on each alternation by exerting an adequate force on a first horn 116 and, on the other hand, to receive an impulse from the other of the horns 116 before exiting the pallet fork.

The FIG. 2*a* illustration more particularly makes it possible to highlight the thickness of the assembly that has just been described.

Figure 1B:
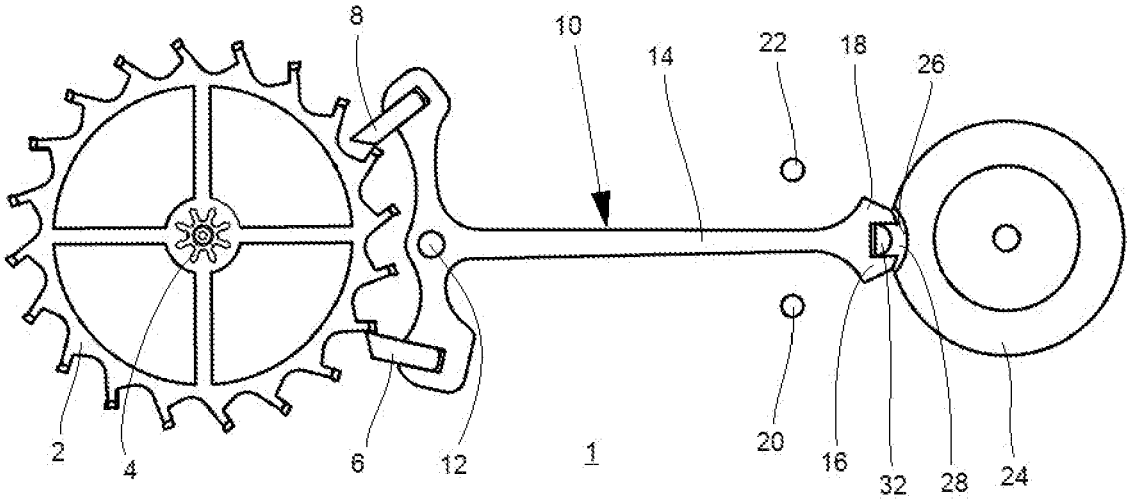
Figure 2B:
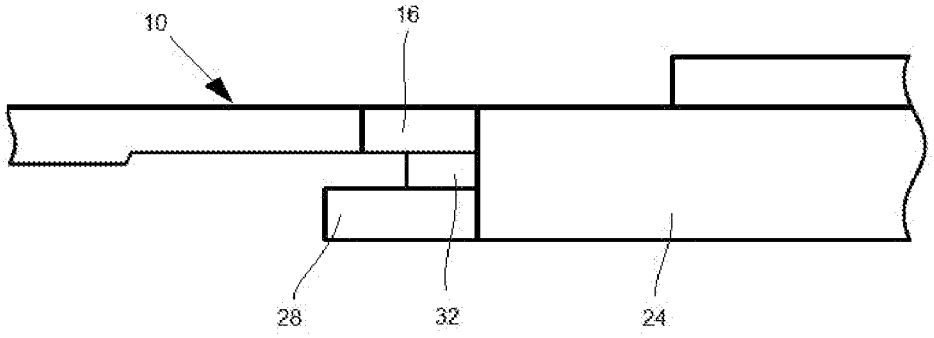

An escapement 1 in accordance with a preferred embodiment of the invention is shown by way of nonlimiting example in FIGS. 1*b* and 2*b*, from which figures it emerges that this escapement includes an escape wheel 2 fastened to an escape pinion 4 and adapted to cooperate with the entry pallet 6 and the exit pallet 8 of pallets 10 intended to pivot on its pallet-staff 12. A lever 14 connects the pallets 6, 8 to a pallet fork the entry of which is delimited by two horns 16, 18. As will emerge hereinafter, apart from their conventional function the horns 16,18 are intended here to make it safe against overbanking. An entry banking pin 20 and an exit banking pin 22 are typically provided to limit the amplitude of rotation of the pallets 10.

The pallets 10 are intended to cooperate with a roller 24 of reduced thickness compared to the conventional double roller. The roller 24 has a cylindrical periphery defining an anti-overbanking wall through its cooperation with the horns 16 and 18, this wall being provided with a notch 26 intended to allow rotation of the pallets 10 on either side of dead centre by providing sufficient room to define a passage for the horns 16, 18. The roller 24 carries a small radial protrusion 28 defining a support for a pin 32 intended to cooperate with the pallet fork of the pallets 10, as will emerge more clearly from the explanations given hereinafter in the description of FIGS. 3*a* to 3*n*.

Accordingly, the fact that the pallets 10 have no guard pin enables reduction of its thickness and that of the roller, as emerges from a comparative examination of FIGS. 2*a* and 2*b*.

However, it should be noted at the same time that the horns 16, 18 replace the guard pin in terms of its anti-overbanking function and have a width greater than the typical width of the guard pin. The notch 26 in the roller 24 must therefore be enlarged compared to conventional escapements and the roller 24 itself must also be enlarged because of this. These modifications imply lengthening of the lever 14 in the situation where the escape wheel 2 is unchanged compared to a conventional Swiss lever escapement, as emerges very particularly from a comparative examination of FIGS. 1*a* and 1 *b*, in such a manner that the pallet fork is able to perform a greater movement without modification of the angle of travel of the pallets 10.

The operation of the escapement 1 according to this preferred embodiment of the invention will now be described with reference to FIGS. 3*a* to 3*n*, which show successive configurations of this escapement in operation, in the same simplified view from above, in which the escape wheel 2 is not represented.

Figure 3A:
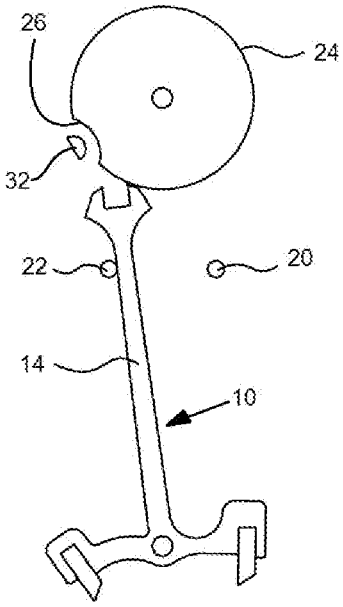
FIGS. 3*a* to 3*n* represent a same simplified view from above of part of the assortment according to the preferred embodiment of the present invention as shown in FIG. 1*b* in successive different configurations.

FIG. 3*a* represents the escapement assembly when the balance wheel (not visible) is in a descending additional angle phase, the pallets 10 and the escape wheel being at rest. In this configuration the lever 14 of the pallets 10 bears against the exit banking pin 22 and the exit pallet 8 of the pallets 10 bears against a tooth of the escape wheel 2.

It may immediately be noted at this stage that if the corresponding timepiece movement were to suffer a jolt in this configuration such that the escape wheel would release the pallets 10, the latter would not be able to pivot given that the horn 16 is arranged in the immediate vicinity of the wall of the roller 24, the latter therefore fulfilling the role of an anti-overbanking wall.

Figure 3B:
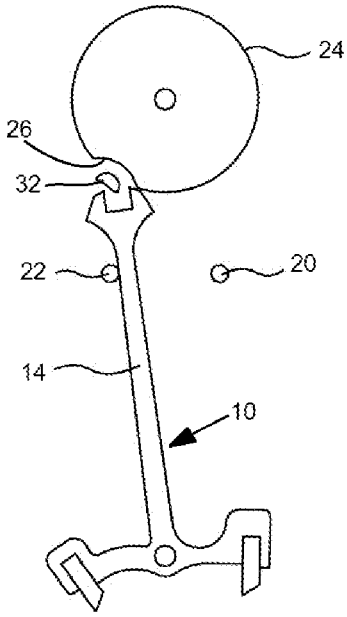

FIG. 3*b* represents a configuration in which the pin 32 of the roller 24 is on the point of entering the pallet fork while it is still situated facing the horn 18. In this configuration, the horn 16 is partly situated facing the notch 26 in the roller 24 but still remains in the vicinity of the anti-overbanking wall and therefore continues to make it safe against overbanking of the pallets 10.

Figure 3C:
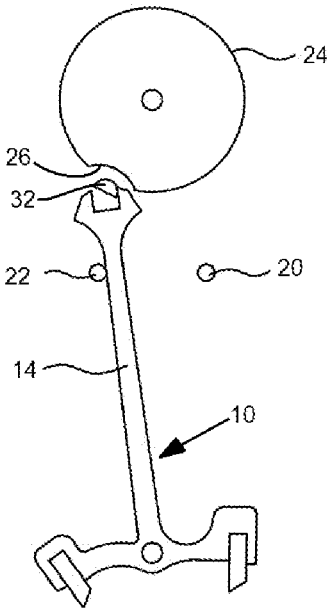
Figure 3D:
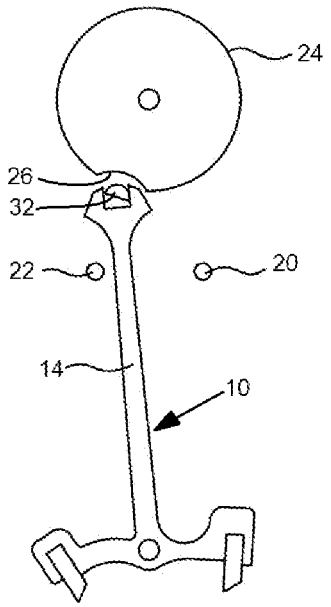

FIGS. 3*c* and 3*d* represent the disengagement phase during which the guard pin 32 comes into contact with the horn 16 and acts on it to cause the pallets 10 to pivot, which assembly then quits its abutment position. At the same time, the pallets 10 begin to be subjected to an impulse by the escape wheel 2, in the conventional manner.

Figure 3E:
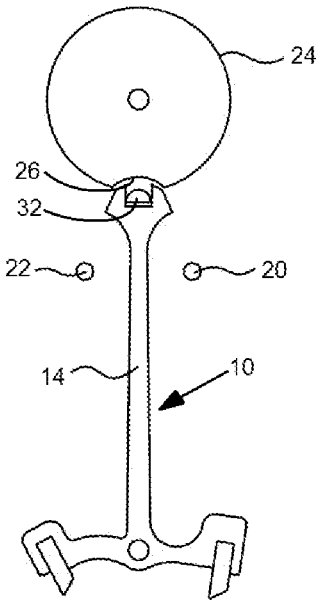
Figure 3F:
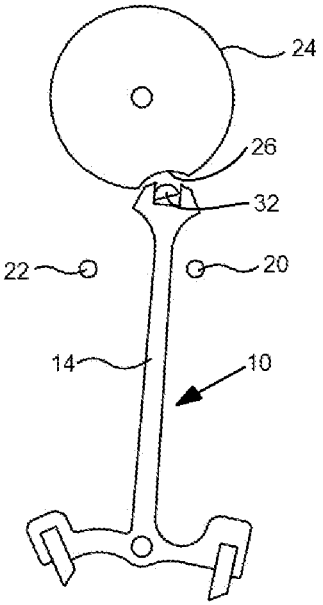
Figure 3G:
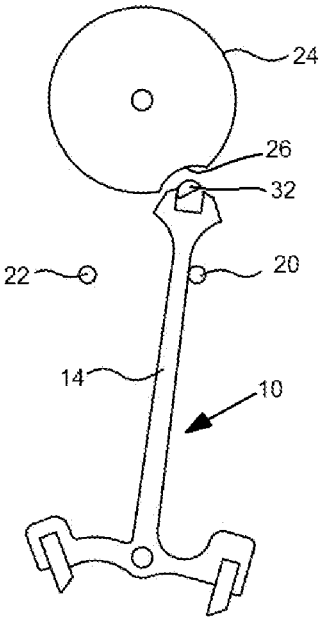

The impulse phase continues as far as the FIG. 3*g* configuration, passing through dead centre, shown in FIG. 3*e*, the pallets 10 transmitting to the balance wheel a fraction of the energy received from the escape wheel 2, via the pin 32 of the roller 24, between dead centre and the end of the impulse phase represented in FIG. 3*g*. At this stage the pallets 10 are locked against the entry banking pin 20 by the escape wheel 2 pulling on the entry pallet 6.

Figure 3H:
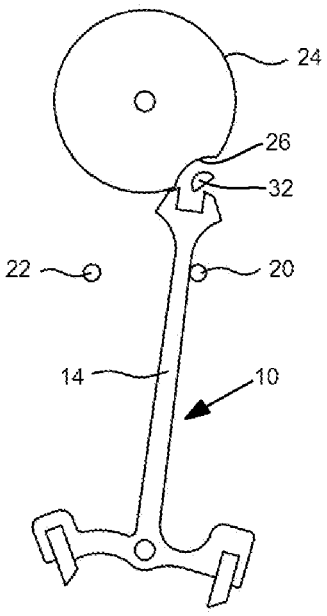
Figure 3I:
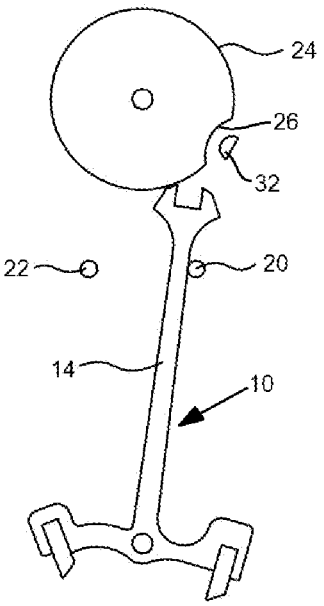

The pin 32 then exits the pallet fork, as represented in FIG. 3*h*, and the balance wheel commences an ascending additional angle phase. It is seen in this figure that the pin 32 exiting the pallet fork coincides with the moment at which the horn 18 arrives in the immediate vicinity of the anti-overbanking wall of the roller 24, thereby locking the pallets 10 in the position represented, as also emerges from the FIG. 3*i* view.

Figure 3J:
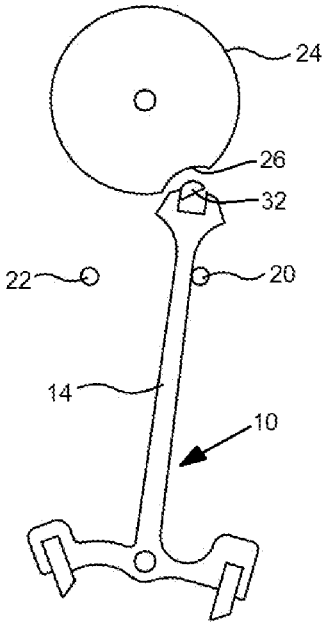

FIG. 3*j* represents the configuration corresponding to the end of the following descending additional angle phase, while the pin 32 has already penetrated into the entry of the pallet fork and comes into contact with the horn 18 to begin the following disengagement phase, in the opposite direction. The pin 32 being situated in the entry of the pallet fork, the notch 26 in the roller is positioned facing the horn 18 to allow pivoting of the pallets 10 in the anticlockwise direction in the FIG. 3*j* view.

Figure 3K:
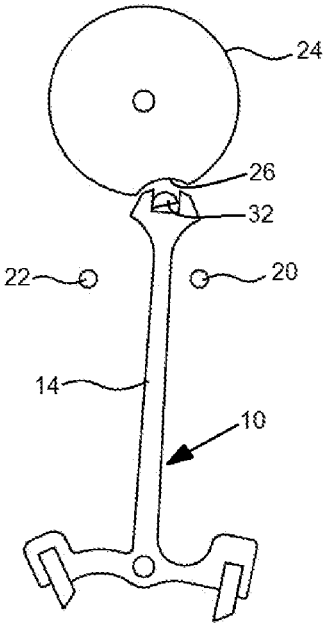
Figure 3L:
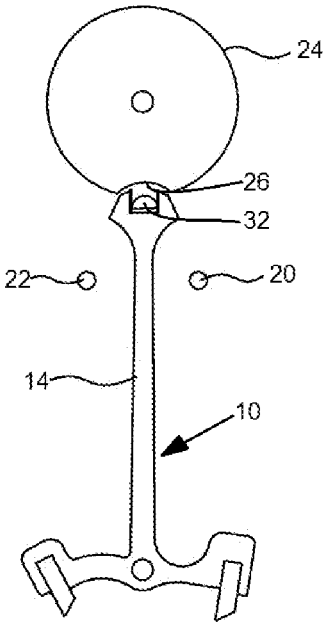
Figure 3M:
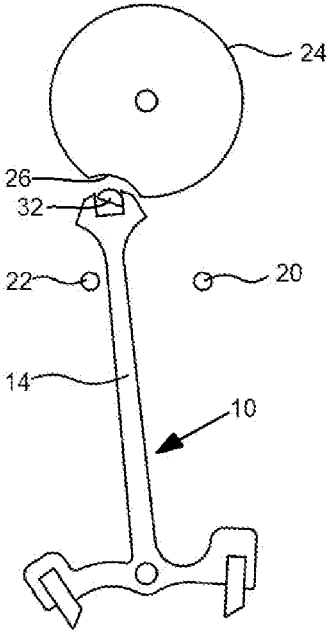

FIGS. 3*k*, 3*l* and 3*m* respectively represent the continuation of the disengagement phase, the passage through dead centre, and then the next impulse phase.

Figure 3N:
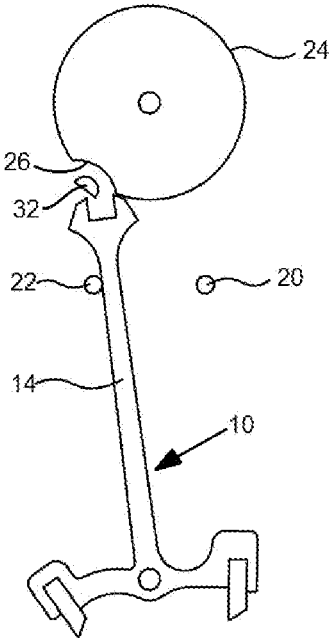

FIG. 3*n* shows the start of the next ascending additional angle phase, of which the next descending additional angle phase corresponds again to the FIG. 3*a* illustration. The configuration shown in FIG. 3*n* corresponds to the moment at which the pin 32 has just quit the pallet fork and it is seen that the horn 16 is then again situated in the immediate vicinity of the anti-overbanking wall of the roller 24.

Figure 4A:
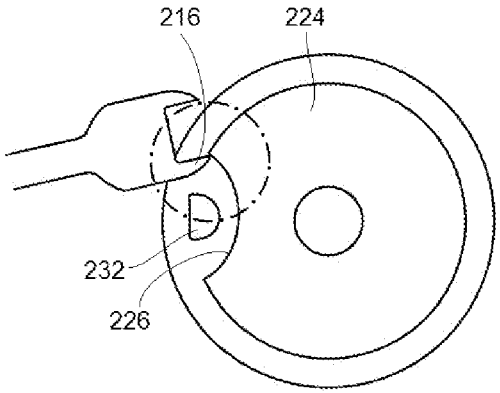
FIGS. 4*a*, 4*b* and 4*c* represent a same simplified view from above of part of an assortment for timepiece movements in a knocking situation, respectively in accordance with a first prior art construction, in accordance with a second prior art construction and in accordance with the preferred embodiment of the invention as shown in FIG. 1*b*.
Figure 4B:
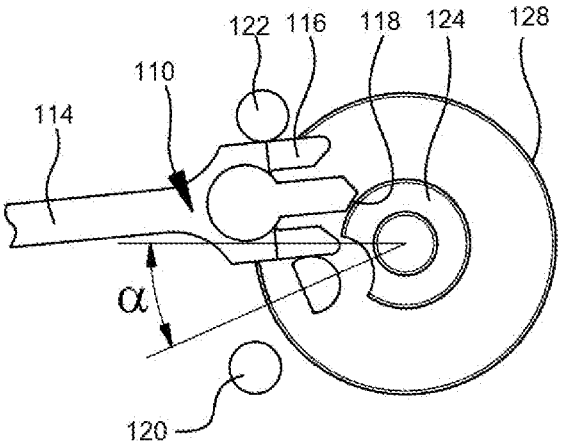
Figure 4C:
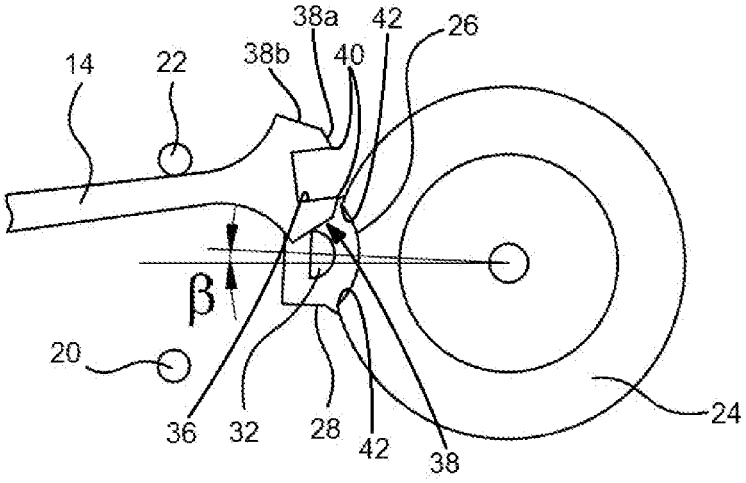

FIGS. 4*a*, 4*b* and 4*c* represent three different types of escapements in the knocking situation and their comparative examination enables highlighting of certain particular features of the present invention.

FIG. 4*a* shows the knocking situation for the prior art escapement as described in the aforementioned patent CH44855 and enables us to show the limitations of that escapement in terms of reliability of operation. As mentioned above, the Applicant has found that this escapement featured a high risk of jamming in the event of knocking in that the horn 216 of the pallet fork, against which the pin 232 has just come to abut in the knocking situation, is liable to penetrate into the interior of the notch 226 in the roller 224 and to prevent rotation of the roller 224 and therefore operation of the corresponding timepiece movement.

FIG. 4*b* shows the knocking situation in the case of the conventional Swiss lever escapement, in which the horns 116 and the guard pin 118 are conformed relative to the roller 124 and to its notch 126 in such a manner that the horns 116 are not able to penetrate into the notch 126 in the knocking situation, because of the abutment of the guard pin 118 against the anti-overbanking wall of the roller 124.

It emerges from FIG. 4*c* that the pallet fork of the pallets 10 has a shape significantly different from the typical shape of conventional pallet fork 4, with the aim of optimizing the nature of its interaction with the peripheral wall of the roller 24.

In fact, each of the horns 16, 18 of the pallet fork has an internal wall 36 delimiting the entry of the pallet fork and an external wall 38 conformed and dimensioned in such a manner that in the knocking situation the distance between the point of contact of the pin 32 on the external wall 38 of the horn concerned (the horn 16 in the configuration shown in FIG. 4*c*) and the end 40 of the external wall 38 nearest the internal wall 36 is greater than the distance between the pin 32 and that of the junctions 42 between the anti-overbanking wall and the notch 26 that is nearest the horn concerned. Thanks to this kind of geometrical arrangement, the horns 16, 18 are not able to penetrate into the notch 26 in the knocking situation, as was the case with the prior art mentioned above, as emerges clearly from a comparative examination of the FIGS. 4*a* and 4*c* illustrations.

Moreover, the external wall 38 of each of the horns 16, 18 has, from its end 40 nearest the internal wall 36, a first portion 38*a* defining a safety surface and having a mean angle relative to the lever 14 of the pallets 10 such that the safety surface is substantially tangential to the anti-overbanking wall when it is situated facing the latter (that is to say essentially when the pallets 10 are in a rest phase), then a second portion 38*b* having an angle of the order of 0 to 60° relative to the lever 14, preferably less than 45°, for example 30°, and extending at least to the point of contact of the pin 32 on the external wall 38 in the knocking situation. Accordingly, the first portion 38*a* able to come into contact with the anti-overbanking wall of the roller 24 offers an area of contact with the latter leading to limited friction. Moreover, this geometry defines horns of greater width than that of the prior art horns, and therefore less fragile and less likely to be damaged in the event of an impact. The orientation of the second portion 38*b* enables further increase in the width of the horns 16, 18 not only to strengthen them but also to be sure that the geometrical condition stated above with reference to the knocking situation is properly met, that is to say that the distance between the point of contact of the pin 32 on a horn in the knocking situation and the end 40 of the external wall 38 of that horn is indeed much greater than the distance between the pin 32 and the junction 42 nearest the horn concerned.

It is therefore apparent in FIG. 4*c* that the assembly according to the present invention offers a level of reliability equivalent to that of the Swiss lever type escapement assembly whilst having a reduced thickness compared to the latter. In fact, the disengagement and impulse functions of the internal wall 36 of the pallet fork are situated at the same level as the anti-overbanking function provided by the external wall 38 of the pallet fork, which functions are implemented at different levels in an traditional lever escapement with a guard pin.

A comparative examination of FIGS. 4*b* and 4*c* further enables an additional advantage of the present invention over a conventional Swiss lever escapement to be noted. It is apparent in FIG. 4*b* that the elongation of the balance wheel at the moment of knocking is of the order of 330 to 340 degrees ($360°-\alpha$ in FIG. 4*b*) while it may be greater than 360 degrees in the case of the invention, as shown in FIG. 4*c*, from which it emerges that here the elongation is $360°+\beta$ ($\beta$ typically having a value of the order of a few degrees), which is more favourable from the point of view of the isochronism of the corresponding oscillator.

Thanks to the features that have just been described, an escapement can be produced conforming to the features of the invention that is of reduced thickness compared to a conventional Swiss lever escapement but having a level of reliability at least equivalent to that of the latter.

Figure 5:
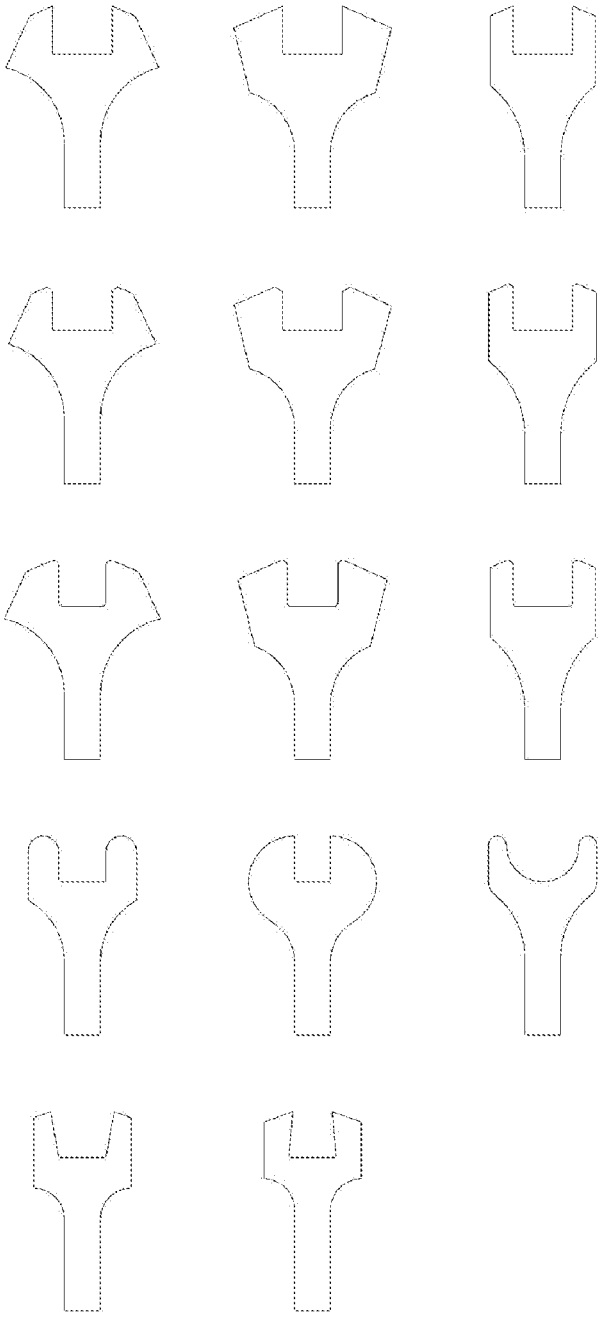
FIG. 5 represents a diagrammatic view from above of a plurality of pallet assemblies according to different respective variant embodiments of the present invention.

The foregoing description aims to describe one particular embodiment by way of nonlimiting illustration and the invention is not limited to the use of certain particular features that have just been described, such as for example the geometry of the pallets 10 or the exact shape of its pallet fork, or even the shape of the roller pin or its support enabling it to be fastened to the roller. In fact, the pin may be fastened to the roller by any appropriate means. There is known in particular the application EP 2924517 that describes one such configuration. The pin may equally be carried directly by the balance wheel for example, without this departing from the scope of the invention. Similarly, the rotation axes of the escape wheel, of the pallets and of the roller may be coplanar or not, without this impacting on the implementation of the invention.

Where the geometry of the pallets 10 is more particularly concerned, FIG. 5 represents a diagrammatic view from above of a plurality of pallets according to respective different variant embodiments of the present invention and makes it possible to get an idea of the flexibility available to the person skilled in the art in designing pallets conforming to the features of the invention.

The person skilled in the art will encounter no particular difficulty in adapting the present teaching to the production of an assembly enabling the production of an escapement in which the pallets have no guard pin but in which its pallet fork is arranged in such a manner that its horns are only able to enter into the notch in the roller when the pin of the latter is situated at least partly inside the pallet fork.

The invention claimed is:

1. An assembly for a lever escapement, the assembly comprising:

a plurality of pallets without a guard pin, the pallets including an entry pallet, an exit pallet, and a pallet fork;

a roller; and a pin fastened to said roller, wherein the pallets, the roller, and the pin are configured, in a service position, to cooperate with one another and with an escape wheel while being safe against knocking, the entry pallet and the exit pallet being configured to cooperate alternately with the escape wheel, the pallet fork being configured to cooperate with said pin and said roller and including first and second horns delimiting a pallet fork entry, said roller being at least partly situated at the same level as said pin, in the direction of the thickness of said roller, said roller having an anti-overbanking wall of cylindrical general shape in which a notch is formed, in a region adjacent to said pin, said pallets, said roller, and said pin being conformed and dimensioned such that, in said service position, said anti-overbanking wall is configured to define an abutment for said first and second horns, and each of said first and second horns is configured to penetrate to the interior of said notch exclusively when said pin is at least partly situated in said pallet fork entry.

2. The assembly of claim 1, wherein each of said first and second horns of said pallet fork has an internal wall delimiting said pallet fork entry and an external wall conformed and dimensioned in such a manner that, in a knocking situation, the distance between the point of contact of said pin on said external wall of the horn concerned and the end of said external wall nearest said internal wall is greater than the distance between said pin and that of the junctions between said anti-overbanking wall and said notch nearest the horn concerned.

3. The assembly of claim 2, wherein said pallets include a lever connecting said entry pallet and said exit pallet to said pallet fork and able to pivot between two extreme positions, in said service position, defining a maximum angle of travel of said pallets, wherein said external wall of each of said horns has, from said end nearest said internal wall, a first portion defining a safety surface and having a mean angle relative to said lever such that said safety surface is substantially tangential to said anti-overbanking wall when said first portion is situated facing said anti-overbanking wall, then a second portion at an angle of the order of 0 to 45° relative to said lever and extending at least to said point of contact of said pin on said external wall in the knocking situation.

4. The assembly of claim 1, wherein said pin is fastened to said roller by a support integral with said roller.

5. The assembly of claim 2, wherein said pin is fastened to said roller by a support integral with said roller.

6. The assembly of claim 3, wherein said pin is fastened to said roller by a support integral with said roller.

7. The assembly of claim 1, wherein said pin is fastened to said roller by a support that is a balance wheel.

8. The assembly of claim 2, wherein said pin is fastened to said roller by a support that is a balance wheel.

9. The assembly of claim 3, wherein said pin is fastened to said roller by a support that is a balance wheel.

10. A lever escapement comprising:

an assembly associated with an escape wheel, said assembly including a plurality of pallets without a guard pin, the pallets including an entry pallet, an exit pallet, and a pallet fork, a roller, and a pin fastened to said roller, wherein the pallets, the roller, and the pin are configured in a service position, to cooperate with one another and with said escape wheel while being safe against knocking, the entry pallet and the exit pallet being configured to cooperate alternately with said escape wheel, the pallet fork being configured to cooperate with said pin and said roller and including first and second horns delimiting a pallet fork entry, said roller being at least partly situated at the same level as said pin, in the direction of the thickness of said roller, said roller having an anti-overbanking wall of cylindrical general shape in which a notch is formed, in a region adjacent to said pin, said pallets, said roller, and said pin being conformed and dimensioned such that, in said service position, said anti-overbanking wall is configured to define an abutment for said first and second horns, and each of said first and second horns is configured to penetrate to the interior of said notch exclusively when said pin is at least partly situated in said pallet fork entry.

11. The lever escapement of claim 10, wherein the lever escapement is configured, in said service position, such that the distance between the rotation axes of said pallets and said roller is at least equal to twice the distance between the rotation axes of said pallets and said escape wheel.

12. The lever escapement of claim 10, wherein the lever escapement is configured, in said service position, such that the rotation axes of said escape wheel, said pallets, and said roller are coplanar.

13. The lever escapement of claim 11, wherein the lever escapement is configured, in said service position, such that the rotation axes of said escape wheel, said pallets, and said roller are coplanar.

14. A timepiece movement comprising:

a lever type escapement including an assembly associated with an escape wheel, said assembly including a plurality of pallets, without a guard pin, the pallets including an entry pallet, an exit pallet, and a pallet fork, a roller, and a pin fastened to said roller, wherein the pallets, the roller, and the pin are configured, in a service position, to cooperate with one another and with said escape wheel while being safe against knocking, the entry pallet and the exit pallet, being configured to cooperate alternately with said escape wheel, the pallet fork being configured to cooperate with said pin and said roller and including first and second horns delimiting a pallet fork entry, said roller being at least partly situated at the same level as said pin, in the direction of the thickness of said roller, said roller having an anti-overbanking wall of cylindrical general shape in which a notch is formed, in a region adjacent to said pin, said pallets, said roller, and said pin being conformed and dimensioned such that, in said service position, said anti-overbanking wall is configured to define an abutment for said first and second horns, and each of said first and second horns is configured to penetrate to the interior of said notch exclusively when said pin is at least partly situated in said pallet fork entry.

15. The timepiece movement of claim 14, further comprising banking pins disposed on respective opposite sides of said pallets to define its maximum angle of travel.

16. A timepiece comprising:

the timepiece movement according to claim 14.

17. A timepiece comprising:

the timepiece movement according to claim 15.

* * * * *